US005247997A

United States Patent [19]

Puccio

[11] Patent Number: 5,247,997

[45] Date of Patent: Sep. 28, 1993

[54] TUBING HANGER WITH A PRELOADED LOCKDOWN

[75] Inventor: William F. Puccio, Houston, Tex.

[73] Assignee: Cooper Industries, Inc., Houston, Tex.

[21] Appl. No.: 866,702

[22] Filed: Apr. 10, 1992

[51] Int. Cl.[5] ..... E21B 33/043

[52] U.S. Cl. ..... 166/348; 166/208

[58] Field of Search ..... 166/348, 208, 182

[56] References Cited

U.S. PATENT DOCUMENTS

| | | | |
|---|---|---|---|
| 3,489,213 | 1/1970 | Hutchison | 166/348 |
| 3,543,847 | 12/1970 | Haeber | 166/208 X |
| 3,693,714 | 9/1972 | Baugh | 166/0.6 |
| 4,067,062 | 1/1978 | Baugh | 166/125 |
| 4,067,388 | 1/1978 | Mouret et al. | 166/208 |
| 4,691,780 | 9/1987 | Galle, Jr. et al. | 166/348 |
| 5,060,724 | 10/1991 | Brammer et al. | 166/208 |
| 5,076,356 | 12/1991 | Reimert | 166/115 |
| 5,110,144 | 5/1992 | Burton et al. | 166/182 X |
| 5,145,006 | 9/1992 | June | 166/341 |
| 5,174,376 | 12/1992 | Singletham | 166/208 |

*Primary Examiner*—Hoang C. Dang

*Attorney, Agent, or Firm*—Jackie L. Duke; Alan R. Thiele; Eddie E. Scott

[57] ABSTRACT

An improved subsea tubing hanger having a body with an external shoulder for landing on a seat within a subsea wellhead housing, locking ring carried on the hanger to engage an interior recess of the wellhead housing with an actuator ring for setting the locking ring. A preloading mechanism includes a biconical radially movable split ring hydraulically actuated by an axially movable conical ring cooperates with the locking ring to prevent any movement of the tubing hanger when engaged.

11 Claims, 5 Drawing Sheets

TUBING HANGER WITH A PRELOADED LOCKDOWN

BACKGROUND

This invention relates to an improved tubing hanger with a provision which allows preloading of the connection of the tubing hanger to the wellhead housing to overcome certain disadvantages of prior subsea tubing hangers.

Tubing hangers are typically designed to support the weight of the associated tubing strings by landing on a seat within the wellhead housing. This seat may be a reduced diameter surface machined on the interior of the wellhead housing or a similar surface on a packoff or casing hanger previously installed in the wellhead housing. The tubing hanger is then secured in this position by urging a split ring carried on the tubing hanger body into a recess in the wellhead housing interior wall which prevents upward movement of the tubing hanger. Due to manufacturing tolerances and debris which may have accumulated on the landing seat in the wellhead housing during prior drilling operations, it has been necessary to make the recess which the split ring engages longer than the split ring. This additional length allows room for the tubing hanger and split ring to reciprocate within the recess as the tubing string lengths grow or contract due to thermal stresses. This reciprocating movement of the tubing hanger is detrimental to the seals installed on the nose of the tubing hanger.

These tubing hangers are typically installed using a running tool which allows manipulation of the tubing hanger and often includes hydraulically operated apparatus for installing and testing the tubing hanger before oil and gas production is commenced. Once the running tool is removed from the tubing hanger and wellhead, residual torsional force exerted on the tubing hanger by the tubing strings suspended below can cause the tubing hanger to rotate with respect to the wellhead housing and move from its original orientation. This loss of orientation can cause damage to the running tool or make it impossible to reinstall the running tool during subsequent tubing string operations. Similarly, a loss of orientation can make it unfeasible to install the subsea tree on the well thereby making it impossible to commence oil or gas production from the well. As drilling and production technology has allowed such operations in deeper water depths, operators have insisted on the use of metal-to-metal seals to seal the annulus between the tubing strings and the last casing string. These metal-to-metal seals are easily damaged by excessive movement after energization. The reciprocating and rotational motions described above are extremely deleterious to these metal-to-metal seals. The present invention overcomes these problems by providing a novel apparatus for preloading the tubing hanger after installation to prevent reciprocating or rotational movement of the tubing hanger and its seals.

U. S. Pat. No. 3,693,714 to B. F. Baugh discloses a typical prior art tubing hanger and running tool which utilizes an expansible lock ring to secure the tubing against upward movement with respect to the wellhead housing.

U. S. Pat. No. 4,067,062 to B. F. Baugh is an example of a tubing hanger allowing use of multiple tubing strings and an associated hydraulic running tool which can run and lock the tubing hanger within the wellhead and is releasable therefrom. The running tool can be subsequently reconnected to the tubing hanger and hydraulically unlatch the tubing hanger and retrieve it to the surface.

U. S. Pat. No. 4,067,388 to E. M. Mouret discloses a running tool and tubing hanger combination which allows release of the tool from the tubing hanger by hydraulic pressure or rotation of the running string to which the tool is attached.

U. S. Pat. No. 5,145,006 to D. R. June discloses a novel running tool and tubing hanger combination which allows preloading of the tubing hanger to wellhead housing connection. This invention utilizes an extendible ring which is operated by the running tool to preload the tubing hanger to wellhead housing connection.

SUMMARY

An improved subsea tubing hanger having a body with an external shoulder for landing on a seat within a subsea wellhead housing, locking means carried on the hanger to engage an interior recess of the wellhead housing including a locking ring and an actuator ring for setting the locking ring. A preloading means including a biconical radially movable split ring hydraulically actuated by an axially movable conical ring cooperate with the locking ring to prevent any movement of the tubing hanger when engaged.

An object of the present invention is to provide an improved tubing hanger and running tool for lowering, landing and locking a tubing hanger within a subsea wellhead housing and preloading the lockdown mechanism to prevent any subsequent axial or rotational movement of the tubing hanger and its metal-to-metal seals relative to the wellhead housing.

Another object of the present invention is to provide an improved mechanism for preloading a tubing hanger to wellhead housing connection which is easily retrofittable to existing designs without requiring modification of existing tubing hanger to wellhead housing lockdown mechanisms.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
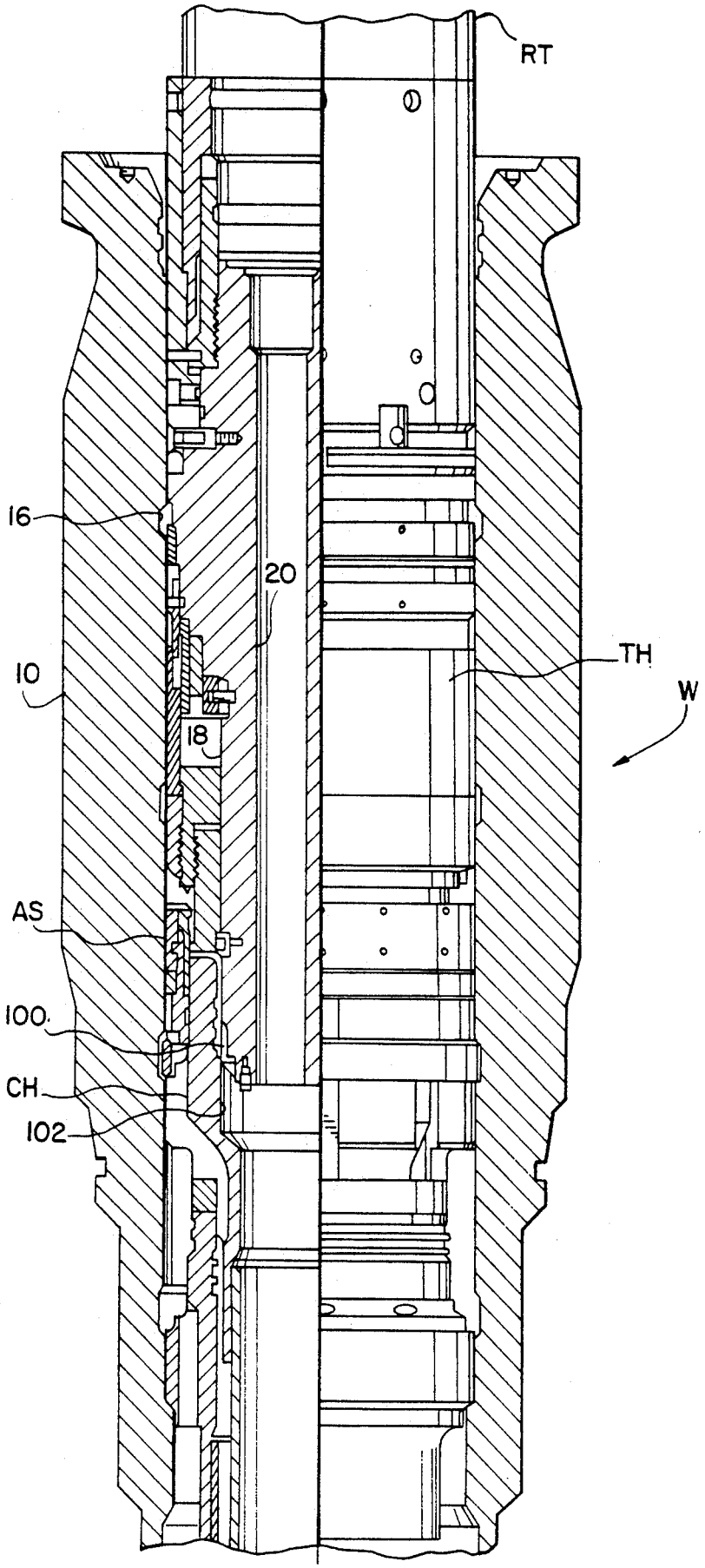
FIG. 1. is an elevation view, in full section, of the preferred embodiment of the improved tubing hanger with preloaded lockdown with the tubing hanger being lowered into the wellhead housing utilizing a running tool.

With reference to FIG. 1, subsea tubing hanger TH has been lowered on running tool RT into position within subsea wellhead W. Casing hanger CH has been previously landed within wellhead W and annulus pack-off assembly AS installed thereabout. A collet connector, blowout preventer stack and riser (not shown) are secured to the upper end of wellhead W in a manner well known to those skilled in the art with the riser extending to the surface for connection to a drilling rig (not shown) for drilling and production operations within the wellhead.

Wellhead W includes wellhead housing 10 with casing hanger CH landed therein having upper face 12 therein for receiving shoulder 14 of tubing hanger TH. Wellhead housing 10 has locking recess 16 formed on its interior above casing hanger CH for coaction with tubing hanger TH as hereinafter described.

Figure 2:
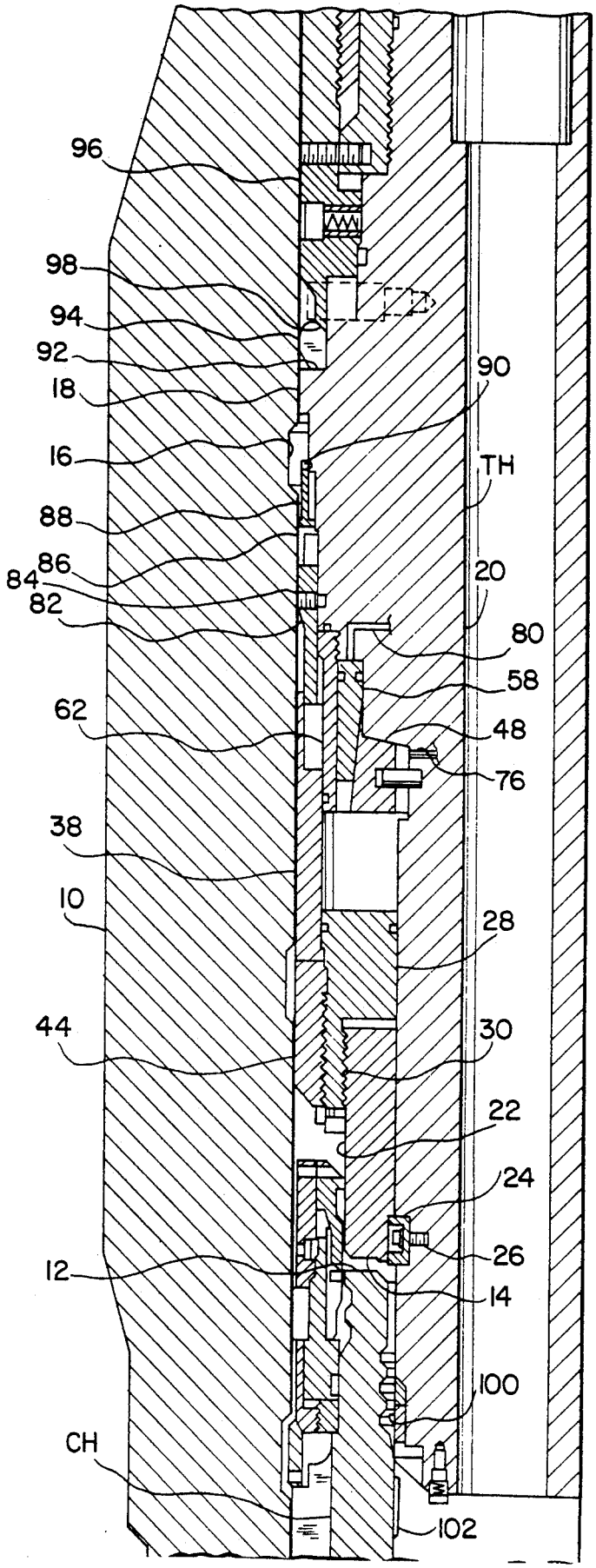
FIG. 2 is an enlarged elevation view of the tubing hanger landed on a casing hanger in the wellhead housing with the running tool omitted for clarity prior to the tubing hanger metal-to-metal seals being activated.

Referring to FIG. 2, tubing hanger TH includes body 18 with tubing passages 20 therethrough with only one of such passages being shown and lower ring 22 secured thereon having shoulder 14 sized to land within casing hanger CH on landing seat 12. Lower ring 22 is axially movable on the exterior of body 18 for purposes to be explained hereinafter. Stop ring 24 is secured on the lower exterior of tubing hanger body 18 with radially disposed cap screws 26 and retains lower ring 22 on tubing hanger body 18.

Piston 28 is connected to lower ring 22 by thread 30 with cap screws 32 ensuring their relative position. The upper exterior portion of piston 28 has shoulder 34 thereon which engages a mating shoulder 36 on outwardly disposed activator ring 38. Suitable sealing means as O rings 40 and 42 are disposed on the interior and exterior of the upper portion of piston 28 and seal against activator ring 38 and tubing hanger body 18. Shoulders 34 and 36 are maintained in contact by retainer ring 44 which engages the exterior of piston 28 with thread 46.

Figure 6:
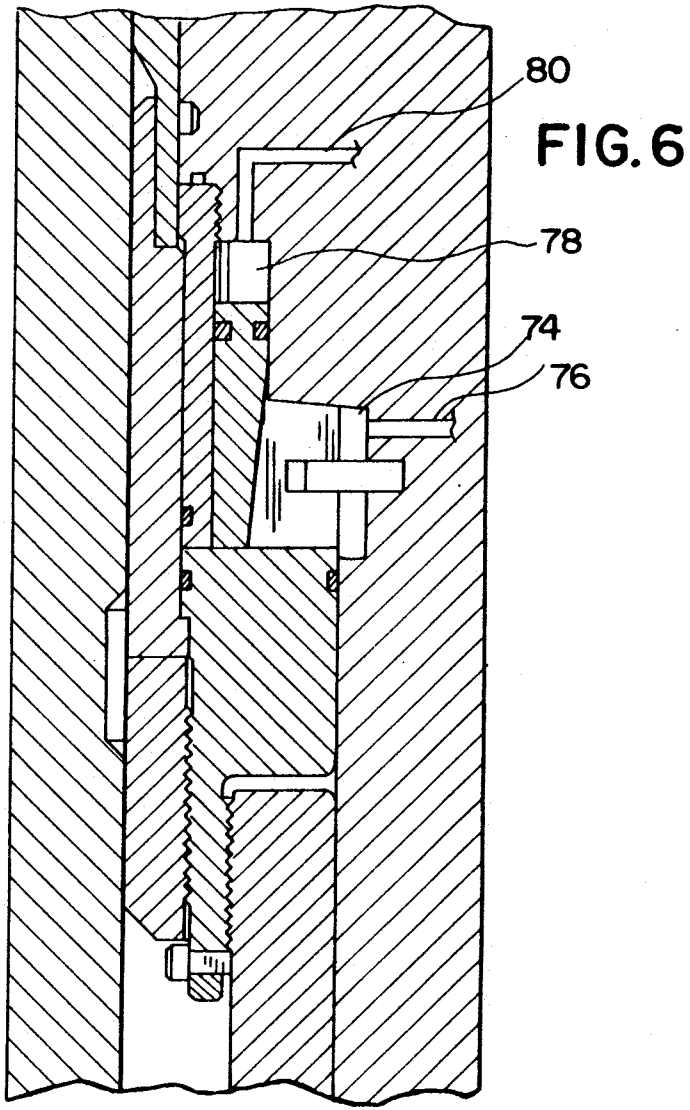
FIG. 6 is a view similar to FIG. 4 on an enlarged scale showing the wellhead housing, tubing hanger and tubing hanger preload mechanism in greater detail with the preload mechanism fully activated.
Figure 5:
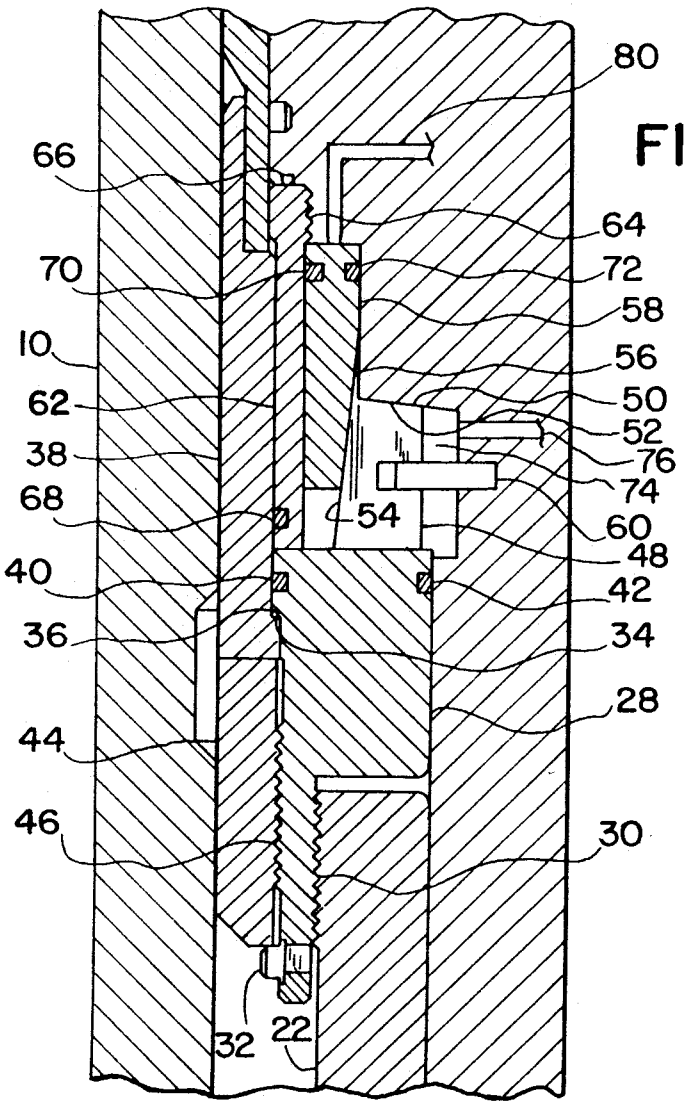
FIG. 5. is a view similar to FIG. 3 on an enlarged scale showing the wellhead housing, tubing hanger and tubing hanger preload mechanism in greater detail prior to activating the preload mechanism.

As best seen in FIGS. 5 and 6 biconical ring 48 is disposed on the exterior of tubing hanger body 18 with upper tapered surface 50 contacting mating tapered surface 52 on the exterior of tubing hanger body 18. Biconical ring 48 has outer circumferential surface 54 which contacts mating tapered surface 56 on the interior of activator ring 58. Biconical ring 48 is a split ring which contracts radially inwardly by the camming action of activator ring 58 acting on surface 54 and is held in its vertical position on tubing hanger body 18 by radially disposed dowel pins 60.

Capture ring 62 is disposed in the annulus between piston ring 58 and activator ring 38 and is connected to the exterior of tubing hanger body 18 by thread 64 with 0 ring seal 66 disposed thereabove. 0 ring 68 is located on the lower exterior of capture ring 62 and seals against the interior of activator ring 38. The upper end of piston ring 58 has suitable sealing means as 0 rings 70 and 72 are disposed on the interior and exterior of the upper portion of piston ring 58 and seal against capture ring 62 and tubing hanger body 18.

0 rings 40, 42, 68, 70 and 72 seal against the interior of activator ring 38 and capture ring 62 and against the exterior of tubing hanger body 18 to form soft landing piston chamber 74 whose function will be described hereinafter. Fluid passage 76 is connected to the running tool RT in a manner well known to those skilled in the art to supply pressurized fluid to soft landing piston chamber 74.

0 rings 66, 70 and 72 seal the annulus between the interior of capture ring 62 and the exterior of tubing hanger body 18 to form preloading chamber 78. Fluid passage 80 is connected to the running tool RT in a manner well known to those skilled in the art to supply pressurized fluid to preloading chamber 78 to allow actuation of biconical ring 48. Seal activation ring 82 is located exteriorly of capture ring 62 and held in its initial unactivated position as best seen in FIG. 2 by shear pins 84 on the exterior of tubing hanger body 18. Annulus seal assembly 86 is disposed immediately above seal activation ring 82 with protection ring 88 thereabove to prevent premature activation of annulus seal assembly 86. Protection ring 88 is held in its unactivated position by shear pins 90 on the exterior of tubing hanger body 18.

Figure 4:
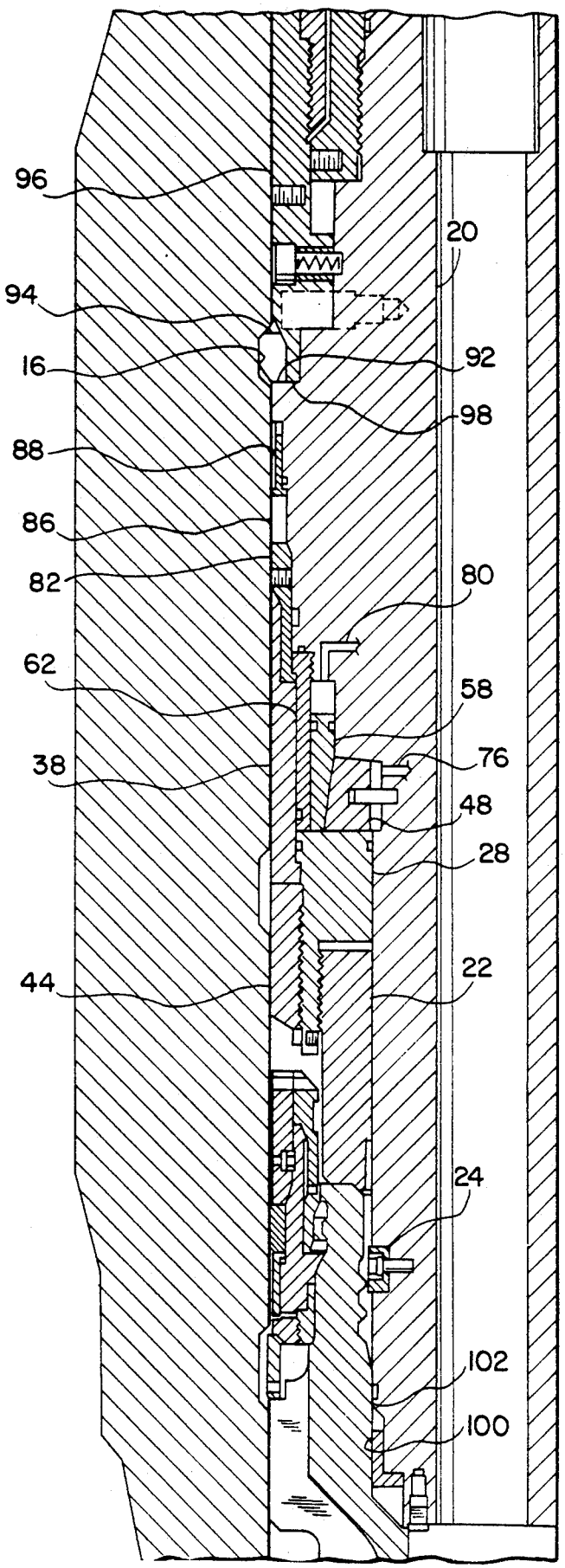
FIG. 4. is a view similar to FIG. 3 with the tubing hanger lockdown engaging the internal recess of the wellhead housing and the tubing hanger preload activated.

Upwardly facing shoulder 92 is axially displaced from protection ring 88 on the exterior of tubing hanger body 18 and is positioned to allow locking ring 94 to be adjacent locking recess 16 when the tubing hanger TH is in its fully landed position as seen in FIG. 4. Locking ring 94 is urged into into its locked position in locking recess 16 by tapered nose 98 of locking ring assembly 96 which is controlled by running tool RT in a manner well known to those skilled in the art.

A typical sequence of events for using the improved tubing hanger and preloaded lockdown is as follows. The tubing hanger TH and running tool RT are assembled as shown in FIG. 1 and pressurized hydraulic fluid is applied through fluid passage 76 to soft piston landing chamber 74 to maintain lower ring 22, piston 28, activator ring 38, retainer ring 44 and piston ring 58 in their initial running position. Preloading chamber 78 is vented through fluid passage 80 and running tool RT to the surface. The tubing hanger TH and running tool RT are then run into the wellhead W in a conventional manner until lower ring 22 contacts upper face 12 of casing hanger CH. Nose seal assembly 100 is disposed on the lower end of tubing hanger TH and is adjacent the seal bore 102 on the interior of casing hanger CH at this point.

Figure 3:
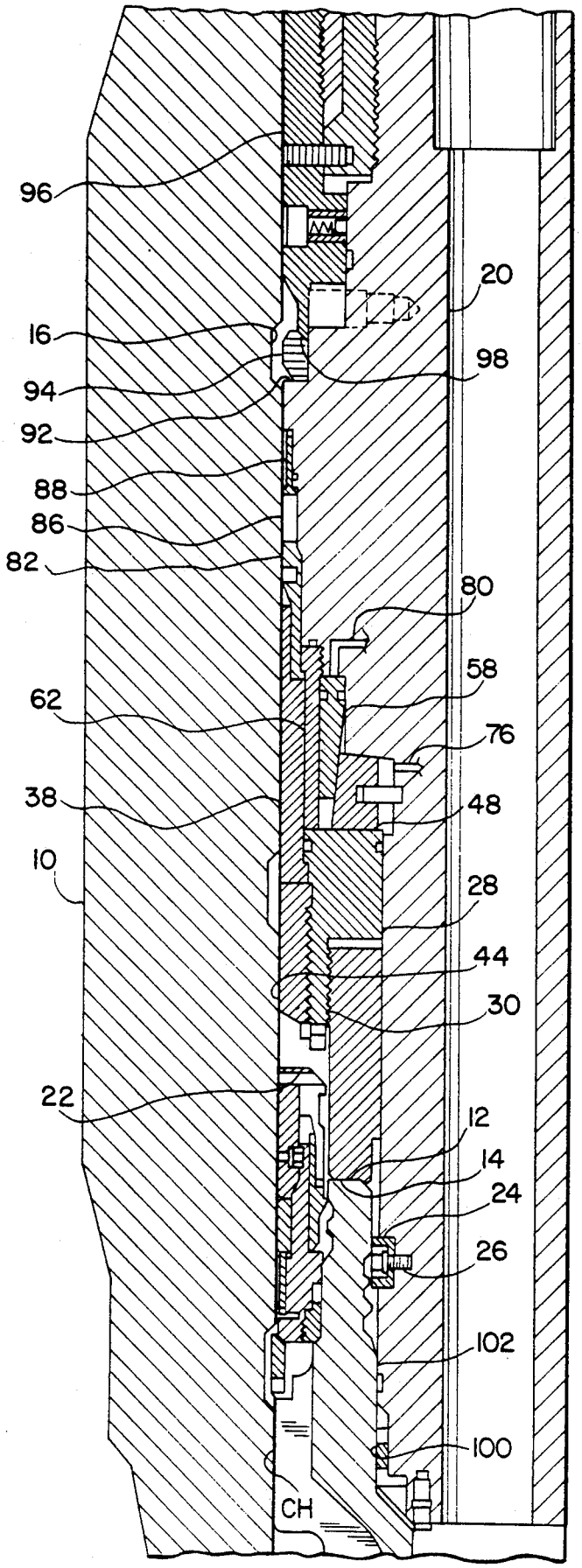
FIG. 3. is a view similar to FIG. 2 with the tubing hanger metal-to-metal seal energized.

The pressurized fluid in soft landing piston chamber 74 is then released allowing the tubing hanger TH and running tool RT to descend to the position shown in FIG. 3 whereby nose seal assembly 100 has engaged the seal bore 102 of casing hanger CH. Simultaneously, tubing hanger body 18 has moved downwardly allowing shoulder 14 to contact landing seat 12 of casing hanger CH and placing locking ring 94 adjacent locking recess 16. The downward movement of tubing hanger body 18 has also caused lower ring 22, piston 28, activator ring 38 and retainer ring 44 to shear pins 84 and 90 allowing annulus seal assembly 86 and protection ring 88 to move to the activated position shown in FIG. 3.

Locking ring assembly 96 is then actuated by hydraulic or mechanical means in a manner well known to those skilled in the art to urge tapered nose 98 downwardly and thereby cam locking ring 94 into locking engagement with locking recess 16. An overpull is then applied to running tool RT to ensure locking ring 94 is securely engaged with locking recess 16. While this overpull is maintained, pressurized hydraulic fluid is applied through fluid passage 80 to preloading chamber 78 to urge piston ring 58 downwardly. This downward movement causes tapered surface 56 to engage outer circumferential surface 54 of biconical ring 48 and cam ring 48 radially inwardly to the position seen in FIGS. 4 and 6. This radial movement of biconical ring 48 causes tapered surfaces 50 and 52 to also engage. The angles of tapered surfaces 50, 52, 54 and 56 are chosen to be selflocking tapers and their engagement thus locks piston ring 58 and biconical ring 48 in place. At this point hydraulic pressure can be removed from preloading chamber 78 and the aforementioned selflocking tapers ensure the preload applied to the tubing hanger is maintained.

Should it be desired to remove tubing hanger TH, running tool RT is rerun in a manner well known to those skilled in the art. The running tool RT can then be relatched to the tubing hanger TH and the tubing hanger TH unlocked from the wellhead housing 10 by activating the locking ring assembly 96 to move tapered nose 98 from behind locking ring 94 thereby allowing ring 94 to contract. The tubing hanger TH and running tool RT can then be retrieved to the surface without the need to release or untorque the tubing hanger preload.

What is claimed is:

1. An improved preloaded lockdown mechanism for a subsea tubing hanger having a running tool latched thereto for use in a subsea wellhead housing having a blowout preventer and a riser above the blowout preventer, comprising:

a landing seat and a locking recess within said wellhead housing, a landing shoulder on said tubing hanger for landing on said landing seat within said wellhead housing, a locking means positioned on said tubing hanger and actuation to engage said locking recess and thereby secure said tubing hanger within said wellhead housing, and a preloading means positioned on said tubing hanger and independently operable of said locking means to preload said locking means and prevent relative movement between said tubing hanger and said wellhead housing.

2. An improved preloaded lockdown mechanism according to claim 1 wherein said preloading means includes:

an external shoulder on said tubing hanger, a contractible ring positioned on said external shoulder, and an actuating means on said tubing hanger coacting with said contractible ring to move said contractible ring between first and second positions and thereby preload said locking means.

3. An improved preloaded lockdown mechanism according to claim 2 wherein:

said contractible ring is of a generally rectangular cross section with a conical upper surface and a conical outer circumferential surface, and said external shoulder on said tubing hanger has a conical surface.

4. An improved preloaded lockdown mechanism according to claim 3 wherein the cone angles of said conical upper surface, said conical outer circumferential surface and said conical external shoulder are self locking.

5. An improved preloaded lockdown mechanism according to claim 4 wherein said actuating means includes an annular piston with an extended lower portion having a conical inner surface with a cone angle matching said cone angle of said conical outer circumferential surface of said contractible ring.

6. An improved preloaded lockdown mechanism according to claim 5 wherein actuation of said annular piston moves said contractible ring from said first position to said second position to develop a preloaded connection between said landing seat and said locking recess in said wellhead housing.

7. An improved preloaded lockdown mechanism for a tubing hanger, comprising:

a landing seat and a locking recess within a wellhead housing, a landing shoulder on said tubing hanger for landing on said landing seat within said wellhead housing, a locking means positioned on said tubing hanger for actuation to engage said locking recess and thereby secure said tubing hanger within said wellhead housing, and a preloading means positioned on said tubing hanger and independently operable of said locking means to develop a preloaded connection between said locking means and said landing seat within said wellhead housing.

8. An improved preloaded lockdown mechanism according to claim 7 wherein said preloading means includes:

an external shoulder on said tubing hanger, a contractible ring having at least one tapered surface and positioned on said external shoulder, and an actuating means on said tubing hanger having at least one tapered surface whose cone angle matches that of said tapered surface of said contractible ring and coacts with said contractible ring to move said contractible ring between first and second positions and thereby preload said locking means.

9. An improved preloaded lockdown mechanism according to claim 8 wherein the cone angles of said actuating means and said contractible ring are self locking.

10. An improved preloaded lockdown mechanism according to claim 9 wherein said actuating means includes an annular piston with an extended lower portion having said tapered surface on its interior.

11. An improved preloaded lockdown mechanism according to claim 10 wherein actuation of said annular piston moves said contractible ring from said first position to said second position to develop said preloaded connection between said landing seat and said locking recess in said wellhead housing.

* * * * *